US008789461B2

(12) United States Patent
Angevine et al.

(10) Patent No.: US 8,789,461 B2
(45) Date of Patent: Jul. 29, 2014

(54) DOUBLE-SIDED PAPER EMBOSSING APPARATUS

(75) Inventors: Faye Angevine, Taipei (TW); Qi Ming Zhang, Dongguan (CN); Li Mei Tai, Taipei (TW)

(73) Assignee: Bai Win Mercantile Corp (H.K.) Ltd., Taipei (TW)

( * ) Notice: Subject to any disclaimer, the term of this patent is extended or adjusted under 35 U.S.C. 154(b) by 504 days.

(21) Appl. No.: 13/154,199

(22) Filed: Jun. 6, 2011

(65) Prior Publication Data

US 2012/0167789 A1 Jul. 5, 2012

Related U.S. Application Data

(60) Provisional application No. 61/429,366, filed on Jan. 3, 2011.

(51) Int. Cl.
*B44B 5/02* (2006.01)
*B44B 5/00* (2006.01)

(52) U.S. Cl.
CPC ..... *B44B 5/0057* (2013.01); *B44B 5/0042* (2013.01); *B31F 2201/0712* (2013.01)
USPC ..... 101/30; 101/24

(58) Field of Classification Search
CPC ..... B44B 5/0042; B44B 5/0057
USPC ..... 101/30
See application file for complete search history.

(56) References Cited

U.S. PATENT DOCUMENTS

| | | | | |
|---|---|---|---|---|
| 756,902 A | | 4/1904 | Shoemaker | |
| 896,478 A | | 8/1908 | Stockman | |
| 1,377,507 A | | 5/1921 | Novotny | |
| 1,453,405 A | | 5/1923 | Platt | |
| 1,658,823 A | | 2/1928 | Willard | |
| 1,992,250 A | | 2/1935 | Stacey | |
| 2,005,340 A | | 6/1935 | Jaffin | |
| 2,019,009 A | | 10/1935 | Hendrix | |
| 2,029,567 A | | 2/1936 | Hough | |
| 2,112,011 A | | 3/1938 | Byerlein | |
| 2,118,888 A | * | 5/1938 | Lewis et al. | 101/131 |
| 2,260,183 A | | 10/1941 | Leslie | |
| 2,381,170 A | * | 8/1945 | Kendig | 101/131 |
| 2,458,867 A | | 1/1949 | Messersmith | |

(Continued)

FOREIGN PATENT DOCUMENTS

| | | |
|---|---|---|
| CN | 2211340 | 8/1995 |
| CN | 2285195 | 1/1998 |

(Continued)

*Primary Examiner* — Anthony Nguyen

(74) *Attorney, Agent, or Firm* — Morriss O'Bryant Compagni, PC

(57) ABSTRACT

A double-sided embossing folder includes a first embossing plate having a first plurality of positive embossing features disposed thereon in the shape of a first image and a first plurality of negative embossing features formed on an opposite side thereof. A second embossing plate has a second plurality of positive embossing features disposed thereon in the shape of the second image configured to mate with the first plurality of negative embossing features and a second plurality of negative embossing features formed therein in the shape of the first image configured to mate with the first plurality of positive embossing features. At least one living hinge is interposed between and integrally formed with the first and second embossing plates. Each living hinge is formed from at least one V-cut formed between the first and second embossing plates to form inwardly tapered sides.

10 Claims, 8 Drawing Sheets

(56) References Cited

U.S. PATENT DOCUMENTS

| | | | | |
|---|---|---|---|---|
| 2,595,970 | A | 5/1952 | McGill | |
| 2,612,123 | A | 9/1952 | Nord | |
| 2,619,173 | A | 11/1952 | Crain | |
| 2,625,908 | A | 1/1953 | Knott | |
| 2,641,781 | A | 6/1953 | Haskell | |
| 2,703,023 | A | 3/1955 | Sarno | |
| 2,754,598 | A | 7/1956 | Aull | |
| 2,791,029 | A | 5/1957 | Leo | |
| 2,821,871 | A | 2/1958 | Sarno | |
| 2,876,575 | A | 3/1959 | Leika | |
| 2,885,933 | A | 5/1959 | Phillips | |
| 2,948,214 | A | 8/1960 | Lotsch | |
| 2,998,766 | A | 9/1961 | Priesmeyer | |
| 3,018,540 | A | 1/1962 | Chavannes | |
| 3,064,559 | A | 11/1962 | Treer | |
| 3,094,091 | A | 6/1963 | Peccerill | |
| 3,128,564 | A * | 4/1964 | Atherton | 434/353 |
| 3,170,358 | A | 2/1965 | Martin | |
| 3,182,530 | A | 5/1965 | Scott et al. | |
| 3,228,263 | A | 1/1966 | Bien | |
| 3,250,163 | A | 5/1966 | Smith | |
| 3,261,044 | A | 7/1966 | Hoff | |
| 3,266,358 | A | 8/1966 | Cox et al. | |
| 3,383,969 | A | 5/1968 | Saunders | |
| D211,608 | S | 7/1968 | Gray | |
| 3,400,625 | A | 9/1968 | Wrona | |
| 3,408,216 | A * | 10/1968 | Mott et al. | 427/1 |
| 3,421,435 | A | 1/1969 | Mueller | |
| 3,511,433 | A | 5/1970 | Andrews et al. | |
| 3,531,863 | A | 10/1970 | Sandborn | |
| 3,534,440 | A | 10/1970 | Roberts | |
| 3,587,382 | A | 6/1971 | Boyd | |
| 3,667,334 | A | 6/1972 | Brunett | |
| 3,669,019 | A * | 6/1972 | Barouh et al. | 101/470 |
| 3,744,384 | A | 7/1973 | Jarritt et al. | |
| 3,756,553 | A | 9/1973 | Ranz | |
| 2,245,770 | A | 6/1974 | Franzmann | |
| 3,863,550 | A | 2/1975 | Sarka et al. | |
| 3,884,490 | A | 5/1975 | Hellman | |
| 3,926,032 | A | 12/1975 | Brooks et al. | |
| 3,935,811 | A | 2/1976 | Lenz et al. | |
| 3,937,389 | A | 2/1976 | Wind | |
| 3,986,447 | A | 10/1976 | Zimmer | |
| 4,052,886 | A | 10/1977 | Buick | |
| 4,065,990 | A | 1/1978 | Edhlund | |
| D257,777 | S | 1/1981 | Eichenberg et al. | |
| 4,273,249 | A | 6/1981 | Florian | |
| 4,278,017 | A | 7/1981 | Conjura | |
| 4,345,516 | A | 8/1982 | Sinclair | |
| 4,444,075 | A | 4/1984 | Mulry | |
| 4,462,291 | A | 7/1984 | Schulz | |
| 4,537,546 | A | 8/1985 | Lucas | |
| 4,542,691 | A | 9/1985 | Kokrhanek | |
| 4,574,693 | A | 3/1986 | Fink et al. | |
| 4,579,022 | A | 4/1986 | Kasai et al. | |
| 4,625,592 | A | 12/1986 | Bayens | |
| 4,638,731 | A | 1/1987 | Kato | |
| 4,692,198 | A | 9/1987 | Borresen | |
| D296,565 | S | 7/1988 | Eichenberg et al. | |
| 4,761,988 | A | 8/1988 | Kato | |
| 4,763,551 | A | 8/1988 | Halff et al. | |
| 4,818,207 | A | 4/1989 | Heron | |
| 4,979,613 | A | 12/1990 | McLaughlin et al. | |
| 4,981,061 | A | 1/1991 | Hilock et al. | |
| D319,771 | S | 9/1991 | Reid et al. | |
| 5,054,389 | A | 10/1991 | Kuhlman et al. | |
| 5,112,423 | A | 5/1992 | Liebe, Jr. | |
| 5,129,157 | A | 7/1992 | Wood | |
| 5,135,533 | A | 8/1992 | Petersen et al. | |
| 5,140,872 | A | 8/1992 | Holliday et al. | |
| 5,172,622 | A | 12/1992 | Sabin | |
| 5,181,464 | A | 1/1993 | Kuhlman et al. | |
| 5,188,026 | A | 2/1993 | Fuqua et al. | |
| 5,230,156 | A | 7/1993 | Patenaude | |
| 5,255,587 | A | 10/1993 | Eichenberg et al. | |
| D341,842 | S | 11/1993 | Eichenberg et al. | |
| 5,275,076 | A | 1/1994 | Greenwalt | |
| 5,344,358 | A | 9/1994 | Jantzen | |
| 5,368,672 | A | 11/1994 | Gunzelman et al. | |
| 5,383,996 | A | 1/1995 | Dressler | |
| D359,967 | S | 7/1995 | Eichenberg et al. | |
| 5,488,889 | A | 2/1996 | Kang | |
| 5,544,549 | A | 8/1996 | Helferich | |
| 5,544,576 | A | 8/1996 | Kato | |
| 5,579,582 | A | 12/1996 | Carlson | |
| 5,590,910 | A | 1/1997 | Meth | |
| 5,622,106 | A | 4/1997 | Rayner | |
| 5,628,226 | A | 5/1997 | Weissman | |
| D380,488 | S | 7/1997 | Elstad et al. | |
| 5,647,278 | A | 7/1997 | Wu | |
| 5,660,105 | A | 8/1997 | Benson et al. | |
| D384,572 | S | 10/1997 | Ongaro | |
| 5,722,319 | A | 3/1998 | Hirano | |
| 5,761,982 | A | 6/1998 | Abt et al. | |
| 5,775,213 | A | 7/1998 | Hyde | |
| 5,778,748 | A | 7/1998 | Beijen | |
| 5,916,335 | A | 6/1999 | Gerhardt | |
| 6,000,139 | A | 12/1999 | Chan | |
| 6,167,807 | B1 | 1/2001 | Maggio | |
| 6,170,376 | B1 | 1/2001 | Strobel et al. | |
| 6,311,601 | B1 | 11/2001 | Love | |
| 6,543,131 | B1 | 4/2003 | Beroz et al. | |
| 6,584,893 | B2 | 7/2003 | Hutchison et al. | |
| 6,626,965 | B2 | 9/2003 | Workman et al. | |
| 6,658,978 | B1 | 12/2003 | Johnson | |
| 6,739,244 | B1 | 5/2004 | Carbaugh | |
| 7,104,192 | B1 | 9/2006 | Corcoran | |
| 7,127,987 | B2 | 10/2006 | Criss | |
| 7,201,101 | B2 | 4/2007 | Oh | |
| 7,284,478 | B2 | 10/2007 | Lee | |
| 7,338,276 | B2 * | 3/2008 | Lee | 425/385 |
| 2002/0117288 | A1 | 8/2002 | Furukoshi et al. | |
| 2002/0139164 | A1 | 10/2002 | Ishihara | |
| 2004/0020328 | A1 | 2/2004 | Wang | |
| 2004/0118304 | A1 | 6/2004 | Corcoran et al. | |
| 2005/0028644 | A1 | 2/2005 | Hughes | |
| 2005/0045522 | A1 | 3/2005 | Corcoran | |
| 2005/0050936 | A1 | 3/2005 | Hughes et al. | |
| 2005/0056166 | A1 | 3/2005 | Corcoran et al. | |
| 2005/0061168 | A1 | 3/2005 | Corcoran et al. | |
| 2005/0211041 | A1 | 9/2005 | Oh | |
| 2005/0215405 | A1 | 9/2005 | Corcoran | |
| 2005/0253324 | A1 | 11/2005 | Corcoran et al. | |
| 2005/0268761 | A1 | 12/2005 | Corcoran et al. | |
| 2006/0027109 | A1 | 2/2006 | Criss | |
| 2008/0003409 | A1 | 1/2008 | Deng | |

FOREIGN PATENT DOCUMENTS

| | | |
|---|---|---|
| CN | 1227166 | 9/1999 |
| CN | 2451301 | 10/2001 |
| CN | 2467286 | 12/2001 |
| CN | 2555993 | 6/2003 |
| CN | 2748294 | 12/2005 |
| DE | 3206718 | 9/1983 |
| GB | 2272661 | 5/1994 |
| JP | 04217497 | 8/1992 |
| JP | 11034184 | 2/1999 |
| JP | 11091296 | 4/1999 |
| JP | 2000127095 | 5/2000 |
| WO | WO 03/016035 | 2/2003 |

* cited by examiner

DOUBLE-SIDED PAPER EMBOSSING APPARATUS

CROSS-REFERENCE TO RELATED APPLICATION

The present invention claims priority to U.S. Provisional Patent Application Ser. No. 61/429,366, filed on Jan. 3, 2011.

BACKGROUND

1. Field of the Invention

The present invention relates generally to devices for creating embossed images in paper and more specifically, to a double-sided embossing folder that produces an embossed image in paper when used in combination with a die press.

2. State of the Art

Various forms of die presses have been developed through the years which use individual die cutting blocks having blades formed into a particular shape that are individually pressed against one or more sheets of paper to produce paper die cuts. More recently, such machines have been employed to produce embossed images in paper by subjecting an embossing device having a sheet of paper sandwiched therein to pressure generated by the die press. Each such prior art cutting or embossing device has been of a single sided configuration with one or more preset images formed into one side of the device. Thus, in order to generate a different image using such a device, a completely new device containing a new desired image or pattern must be used.

Thus, there exists a need in the art to provide an embossing device that is capable of producing at least two different embossed images or patterns in paper using a single device with dual side capabilities.

SUMMARY OF THE INVENTION

According to the present invention, a double-sided embossing folder comprises a first embossing plate having a first planar surface including a first plurality of positive embossing features disposed thereon in the shape of a first image and a second planar surface opposite the first planar surface including a first plurality of negative embossing features formed therein defining a second image. The first and second images are different from one another. A second embossing plate has a third planar surface including a second plurality of positive embossing features disposed thereon in the shape of the second image and is configured to mate with the first plurality of negative embossing features. A fourth planar surface opposite the third planar surface includes a second plurality of negative embossing features formed therein in the shape of the first image and is configured to mate with the first plurality of positive embossing features. At least one living hinge is interposed between and integrally formed with the first and second embossing plates. The at least one living hinge is formed from at least one V-cut formed between the first and second embossing plates to form inwardly tapered sides.

In one embodiment, the living hinge is comprised of a single living hinge defined by a first pair of inwardly tapered portions extending from the second and third planar surfaces to a web portion and a second pair of inwardly tapered portions extending from the first and fourth planar surface to the web.

In still another embodiment, the first and second pair of inwardly tapered portions have a slenderness ratio sufficient to allow the single living hinge provide pivoting of the first embossing plate nearly 360 degrees relative to the second embossing plate and to allow engagement of corresponding positive and negative embossing features on both sides of the embossing folder to properly engage during embossing.

In yet another embodiment, the ratio of the length to thickness of the inwardly tapered portions is approximately between about 5:1 and 7.5:1.

In still another embodiment, he at least one living hinge is comprised of a pair of oppositely oriented living hinges lying in parallel to one another and extending transversely between the first and second embossing plates.

In another embodiment, the pair of living hinges is spaced from one another by a strip of material having a substantially parallelogram-shaped cross-section.

In yet another embodiment, the pair of living hinges is each defined by inwardly angled surfaces to form a corresponding V-cut on opposite sides of the embossing folder.

In still another embodiment, the inwardly angled surfaces of one living hinge prevent relative bending between the one living hinge and the strip of material when the bending causes contact between the inwardly angled surfaces.

In another embodiment, when the at least one living hinge is bent until the first planar surface contacts and lies substantially planar to the fourth planar surface or the second planar surface contacts and lies substantially planar to the third planar surface, the inwardly tapered sides form a tapered leading edge.

The foregoing advantages and characterizing features will become apparent from the following description of certain illustrative embodiments of the invention. The above-described features and advantages of the present invention, as well, as additional features and advantages, will be set forth or will become more fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION OF THE ILLUSTRATED EMBODIMENTS

Figure 1:
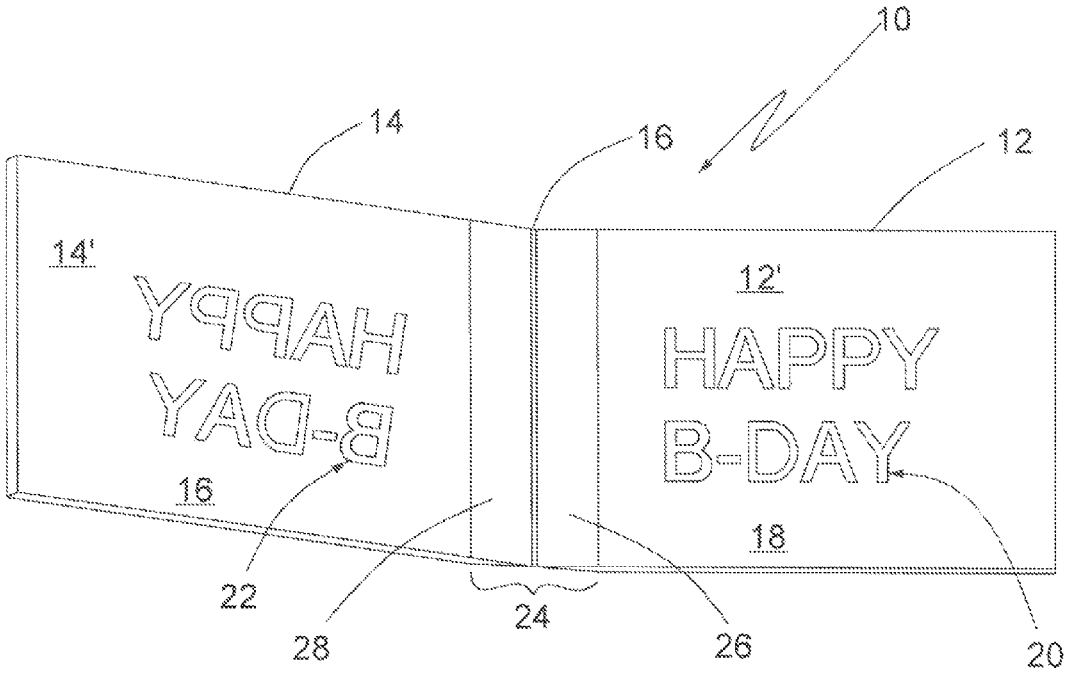
FIG. 1 is a perspective view of a first embodiment of a double-sided embossing folder in accordance with the principles of the present invention.

As shown in FIG. 1, a first embodiment of a paper embossing device, generally indicated at 10, is illustrated. The embossing device 10 is comprised of a single, unitary sheet of plastic with two embossing halves 12 and 14 separated by a living hinge 16. The embossing device 10 is comprised entirely of plastic. In particular, the embossing device is comprised of polypropylene because it has been found capable of providing sufficient rigidity for the embossing portions and demonstrates excellent fatigue resistance such that the living hinge 16 is capable of being repeatedly flexed nearly 360 degrees to ensure that the embossing device 10 can be used hundreds, if not thousands or millions of times, without breaking along the living hinge. The living hinge 16 is formed from a thinned section of the plastic that allows the plastic to bend, shuts allowing movement of the two embossing halves 12 and 14 relative to one another. This thinned section produces minimal friction and very little wear from repeated bending. In addition, because the entire embossing device 10 can be formed in a single manufacturing step, such as an injection molding process, the embossing device 10 can be easily manufactured at relatively low cost.

The two embossing halves 12 and 14 are each comprised of relatively flat sheets of material joined together by the living hinge 16. The embossing portions 12' and 14' of each embossing halve 12 and 14, respectively, provide planar surfaces 16 and 18, with the embossing portion 12' having raised embossing features 20 and the embossing portion 14' having recessed embossing features 22. The raised embossing features 20 are positioned and configured, with slightly smaller dimensions, to match the recessed features 20 and so as to fit within the recessed features 20 when the surface 16 is brought into contact with surface 18. Because the raised embossing features 20 and recessed embossing features 22 are mirror images of one another, the raised embossing features 20 can mate with the recessed embossing features 22 so as to cause the embossing of the features 20 into a sheet of paper (not shown) that can be inserted between the two embossing halves 12 and 14 when the two embossing halves 12 and 14 are pressed together.

The hinge portion 24 is formed by tapered portions 26 and 28 that are at their widest where they interface with the planar surfaces 16 and 13, respectively, and narrow toward the living hinge 16. The tapered portions 26 and 28 are substantially equally tapered on each side of the living hinge 16 and, as will be described in more detail, are substantially equally tapered on both the front sides and back side thereof. This allows the living hinge 16 to bend sufficiently in either direction to allow the embossing device 10 to be used with the embossing features 20 and 22 on the front surfaces 16 and 18 or to be used with embossing features (not visible) on the back surfaces thereof.

Figure 2:
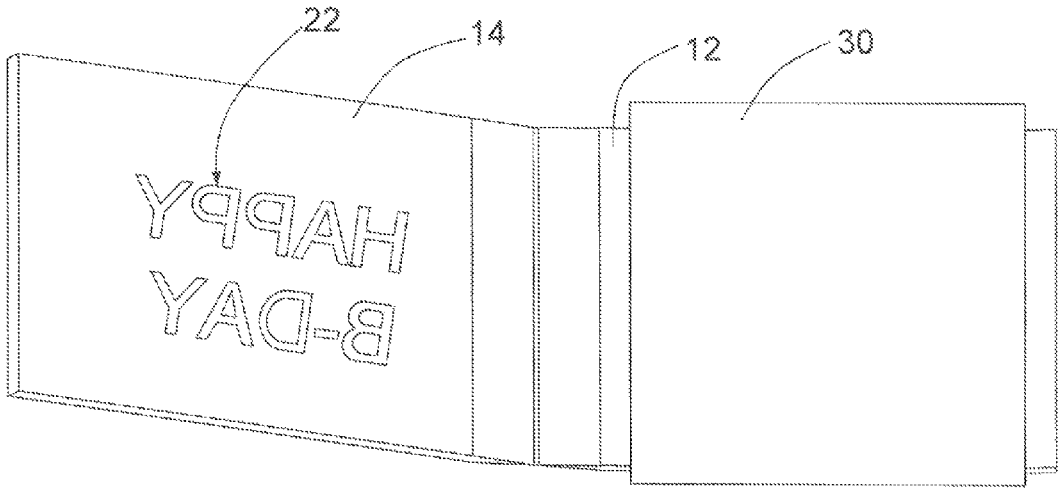
FIG. 2 is a perspective view of the double-sided embossing folder shown in FIG. 1 with a sheet of paper.

As further illustrated in FIG. 2, to emboss a sheet of paper 30, the sheet of paper 30 is placed between the two embossing halves 12 and 14. The sheet of paper 30 is aligned with the embossing features 20 (not visible) and 22 so that the embossed image created therefrom will be positioned and oriented on the paper 30 at the desired location. Thus, the paper 30 can be moved and rotationally oriented to cause the embossing to occur as desired.

Figure 3:
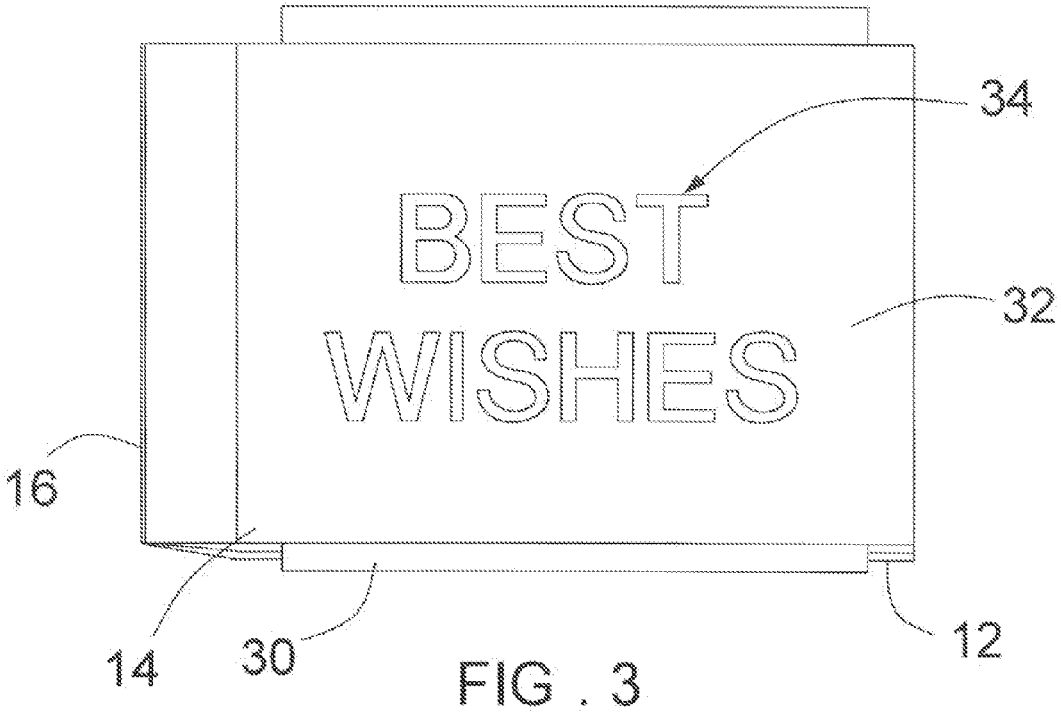
FIG. 3 is a perspective front view of the double-sided embossing folder shown in FIG. 1 in a folded configuration with the sheet of paper.
Figure 4:
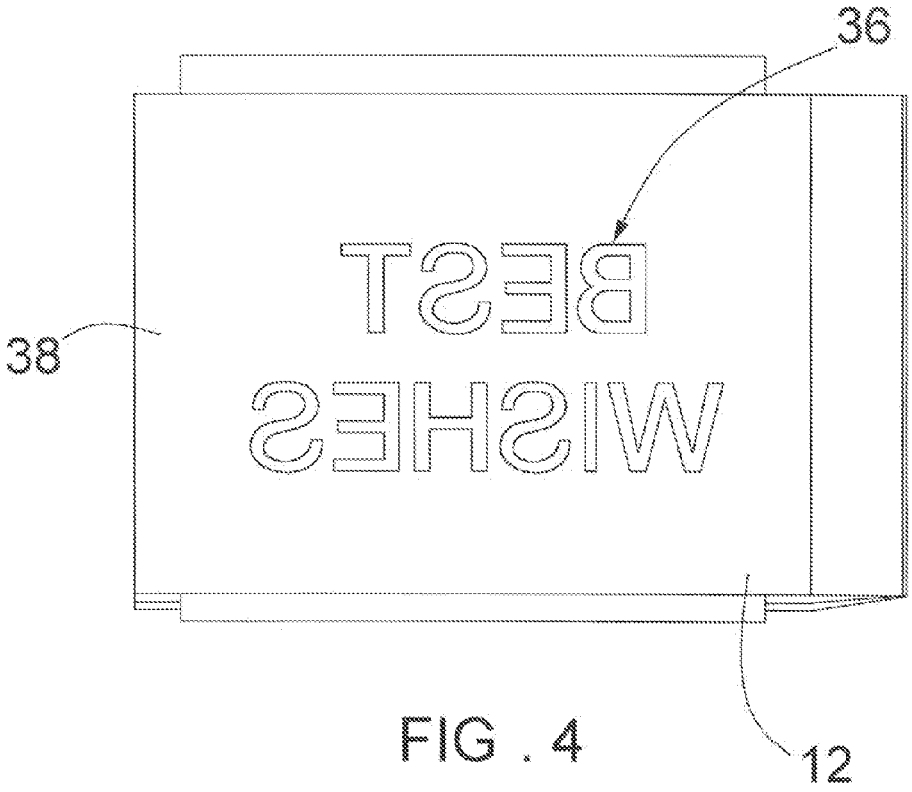
FIG. 4 is a perspective back view of the double-sided embossing folder shown in FIG. 1 in a folded configuration with the sheet of paper.

Then, as shown in FIG. 3, the embossing half 14 is folded about the living hinge 16 over the embossing half 12 with the sheet of paper 30 sandwiched therein between. As further shown, the back side 32 of the embossing half 14 is provided with another plurality of embossing feature 34 in positive form. The positive embossing features 34 are configured to mate with a plurality of cooperating negative embossing features 36 shown in FIG. 4 that are formed in the back side 38 of the embossing half 12 when the two halves 12 and 14 are closed in an opposite direction such that the sides 32 and 38 come together and the embossing features 34 engage with the embossing features 36.

Figure 5:
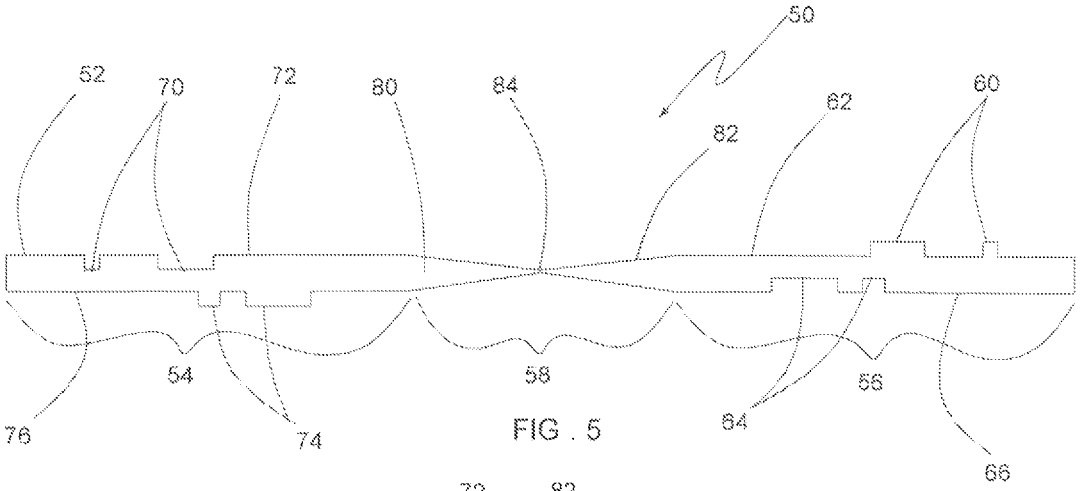
FIG. 5 is a cross-sectional side view of a second embodiment of a double-sided embossing folder in accordance with the principles of the present invention.

FIG. 5 illustrates in cross-section, yet another embodiment of a double-sided embossing folder, generally indicated at 50, in accordance with the principles of the present invention. The embossing folder 50 is comprised of an elongate sheet of plastic 52 having substantially planar embossing portions 54 and 56 with a hinge portion 58 disposed integrally between the embossing portions 54 and 56. Each of the embossing portions 54 and 56 are provided with positive and negative embossing features. In this example, positive embossing features 60 of the embossing portion 56 are positioned on a top side 62 of the embossing portion 54 and negative embossing features 64 are positioned on a bottom side 66 of the embossing portion 56. Likewise, coordinating negative embossing features 70 are provided in the top side 72 of the embossing portion 54 for mating with embossing features 60, while positive embossing features 74 are provided on the bottom side 76 of the embossing portion 54 form mating with the negative embossing features 64 of embossing portion 56. By including the positive features of one embossed image on one side of the embossing portion and negative features of another embossed image on the opposite side of the same embossing portion, the overall thickness of the embossing portion can be optimized while maximizing structural strength and integrity of the embossing portion. In other words, the thickness of the embossing portion can be optimized to accommodate recesses of an embossed image that are provided in one side of the embossing portion, with positive embossing features provided on the opposite side of the embossing portion that protrude from the surface thereof and thus only increase the thickness of the embossing portion where such positive embossing features are positioned.

Figure 6:
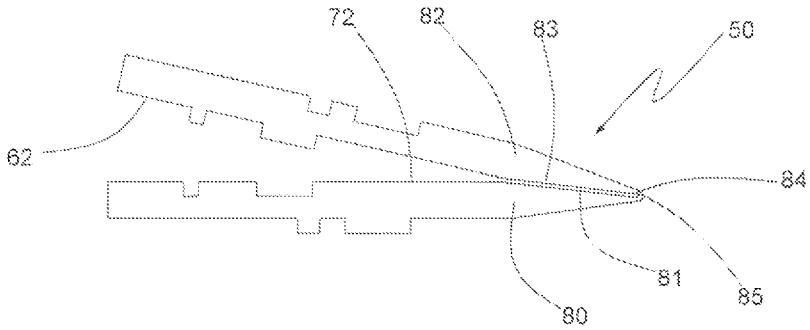
FIG. 6 is a cross-sectional side view of the double-sided embossing folder shown in FIG. 5.
Figure 7:
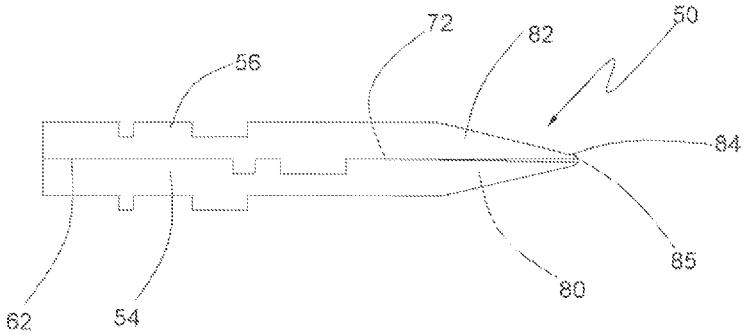
FIG. 7 is a cross-sectional side view of the double-sided embossing folder shown in FIG. 5.

The hinge portion 58 is comprised of inwardly tapered portions 80 and 82 that are tapered from both bottom sides 66 and 76 and top sides 62 and 72, essentially forming a wide V notch in each side of the embossing folder with the bottoms of each V notch being positioned at the living hinge 84. The living hinge 84 is formed from a relatively small web of material having a relatively small width and thickness that allows the embossing portions 54 and 56 to be brought together. As shown in FIGS. 6 and 7, as the web 85 is bent, the surface 62 is pivoted about the living hinge 85 until the facing surfaces 81 and 83 of the tapered portions 80 and 82, respectively contact each other. Continued compression of the by providing elongated tapered portions 80 and 82 causes the tapered portions 80 and 82 and the embossing portions 54 and 56 to flex in a direction transverse no the planar surfaces defined by the top sides 62 and 72 until the surfaces 72 and 62 meet. In the configuration illustrated in FIG. 7, the two embossing portions 54 and 56 will have a natural bias away from each other as the embossing device 50 will return to a position such as that illustrated in FIG. 6. In order for the embossing device to function properly, the thickness of each embossing portion 54 and 56, not including any positive embossing features 60 or 74 is approximately 1 to 6 mm, with the raised embossing features 60 and 74 having a height of approximately 0.2 to 0.5 mm and the corresponding negative or recessed embossing features 64 and 70 having a depth slightly larger (e.g., <0.1 mm greater) than the corresponding positive or raised embossing feature. The width of the web 85 that forms the living hinge 84 is approximately 0.2 to 0.4 mm with a thickness or height of approximately 0.2 mm. The distance between the center of the web 85 that forms the living hinge 84 and the first positive embossing feature is at least approximately 2 to 4 mm. This allows the embossing features of the two halves of the embossing folder 50 to properly engage so that the positive embossing features 60 or 74, as the case may be, nearest the living hinge 84 do not interfere with the closing of the embossing folder 50.

For an embossing folder having a base thickness of approximately 2 mm, the length of each tapered portion 80 and 82 is approximately 10 to 15 mm. At 12 to 13 mm, the tapered portions 80 and 82 provide a sufficient slenderness ratio so at to allow the positive and negative embossing features on both sides of the embossing folder 50 to properly engage during embossing. Thus, in order for the embossing folder 50 to close properly in both directions about the living hinge 84 and allow the positive and negative embossing features to properly align and engage, the ratio of the length of the tapered portions 80 and 82 to the width of the tapered portions 80 and 82 at their widest point is approximately between about 5:1 and 7.5:1. Of course, greater ratios could be employed to extend the length of each tapered portion. An optimal ratio that allows the tapered portions to adequately flex or bend toward one another (in both directions of bending of the living hinge 84) to allow the two halves of the embossing folder to meet in either direction is about 6.5:1. In other words, the two tapered portions can bend along their length, which bending gradually increases toward the living hinge 84 as the tapered portions 80 and 80 become thinner, as shown in FIG. 7. This allows the surfaces 62 and 72 to abut one another along their entire surfaces for embossing purposes.

Figure 8:
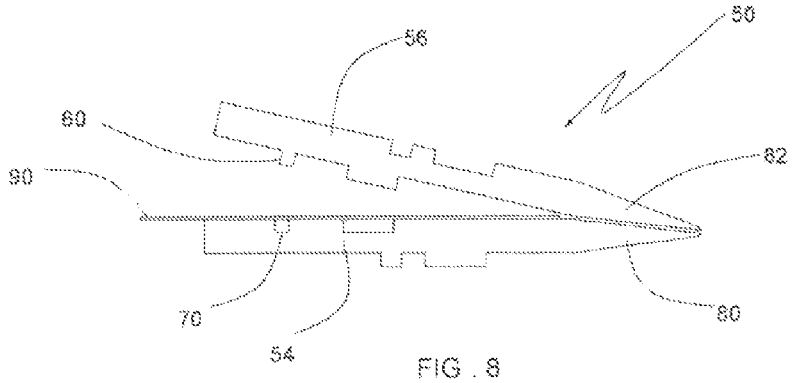
FIG. 8 is a cross-sectional side view of the double-sided embossing folder shown in FIG. 5 with a sheet of paper.

As shown in FIG. 8, to emboss a sheet of paper 90, the sheet of paper 90 is inserted between the two embossing portions 54 and 56 of the embossing folder 50 with the embossing portion 56 positioned over the embossing portion 54. In this example, the positive embossing features 60 will be embossed into the sheet of paper 90 as they engage, with the paper disposed therein between, with the corresponding negative embossing features 70.

Figure 9:
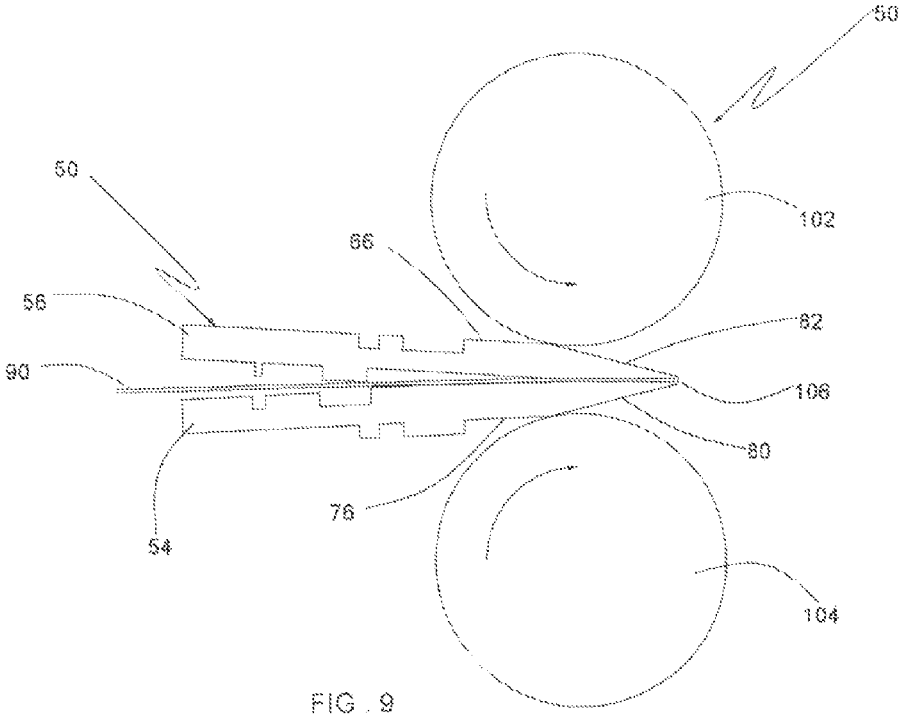
FIG. 9 is a cross-sectional side view of the double-sided embossing folder shown in FIG. 5 with a sheet of paper being fed through a roller-type machine.

As shown in FIG. 9, the embossing folder 50 is particularly designed to work with a roller-type embossing machine 100 that is configured with a pair of counter-rotating rollers 102 and 104. The rollers 102 and 104 are typically comprised of steel cylinders, but may be comprised of other materials as is known in the art. The spacing between rollers 102 and 104 at their nearest tangential points is such that the embossing folder 50 is compressed as it passes between the rollers so as to force the paper 50 into the negative recesses of the negative embossing features 70 to emboss the image represented by the positive and negative embossing features 60 and 70 into the paper. The tapered ends 80 and 82 of the embossing folder 50 provide a tapered proximal end 106 that is self guiding through the rollers 102 and 104. In addition, because of the thinness of the embossing portions 54 and 56 and the material from which they are constructed it may be the case that the embossing folder 50 will be configured as shown in FIG. 8 in its resting/uncompressed state such the embossing portions 54 and 56 are spaced apart. By inserting the tapered proximal end 106 into the roller press 100 first, however, the rollers will engage the tapered portions 80 and 82 before engaging the surfaces 66 and 76. This initial engagement of the tapered portions 80 and 82 causes the positive and negative embossing features 60 and 70 to become properly aligned so that as they pass between the rollers 102 and 104, they will engage each other to emboss the sheet of paper 90. Indeed, as illustrated in FIG. 9, the embossing portions 54 and 56 may actually be spaced apart over a substantial portion of their length until brought together by the rollers 102 and 104 during the embossing process.

Figure 10:
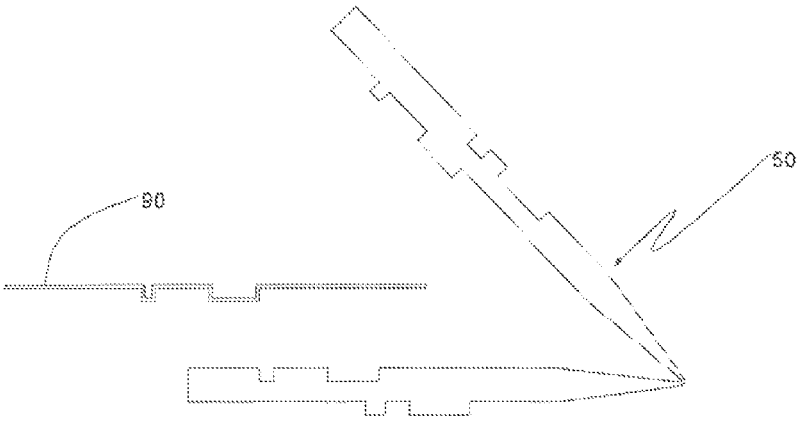
FIG. 10 is a cross-sectional side view of the double-sided embossing folder shown in FIG. 5 with an embossed sheet of paper.

As shown in FIG. 10 after the embossing folder 50 has completely passed through the die press rollers 102 and 104 of FIG. 9, the embossing folder 50 can be opened as shown and the sheet of paper 90 that is now embossed with the positive features of the embossing folder 50 can be removed. The process can then be repeated for embossing other sheets of paper, or depending on size, the same sheet of paper with the same or a different embossed pattern. It should be noted that while the embossing process illustrated and described with particular reference to FIGS. 8, 9 and 10 have included the use and advantages of a roller-type die press, the embossing folder 50 of the present invention could also be used with a platen-type die press in which the embossing folder 50 is positioned on a flat surface and an upper flat surface is positioned over the embossing folder 50 and is brought into contact with the top of the embossing folder 50 compressing the embossing folder between the upper flat surface and the lower flat surface to cause embossing of a sheet of paper positioned within the embossing folder 50 as previously described herein.

Figure 11:
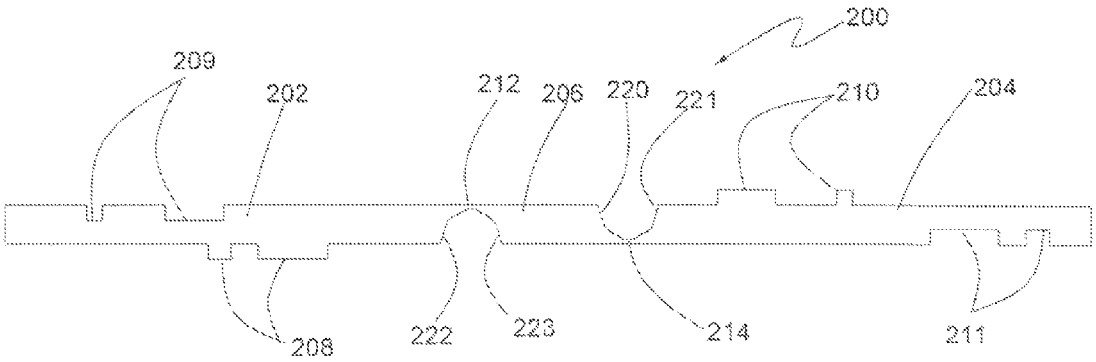
FIG. 11 is a cross-sectional side view of a third embodiment of a double-sided embossing folder in accordance with the principles of the present invention.
Figure 12:
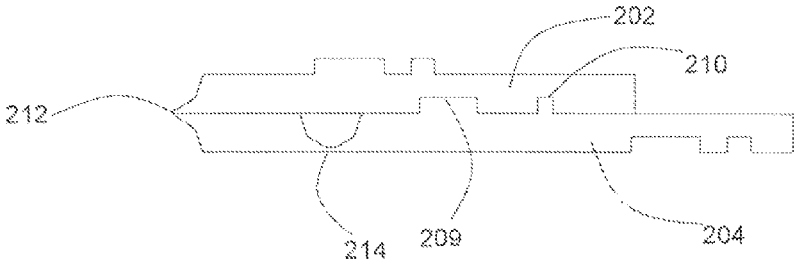
FIG. 12 is a cross-sectional side view of the double-sided embossing folder shown in FIG. 11.
Figure 13:
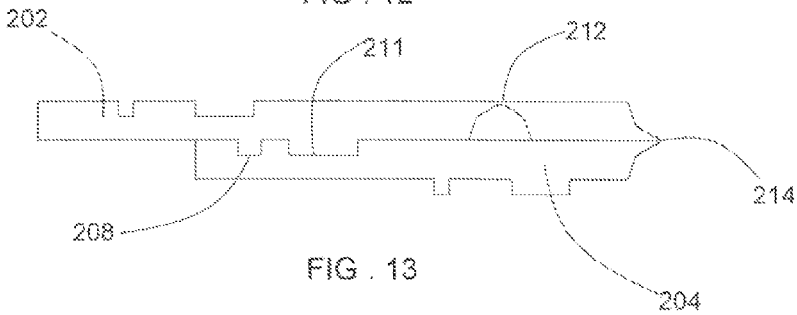
FIG. 13 is a cross-sectional side view of the double-sided embossing folder shown in FIG. 11.

Referring now to FIG. 11, there is illustrated another embodiment of a double-sided embossing folder, generally indicated at 200, in accordance with the principles of the present invention. In this example, the embossing folder 200 is comprised of a first, double-sided embossing portion 202 and a second, double-sided embossing portion 204 separated and adjoined by a hinge portion 206 that is configured to allow the positive and negative embossing features 208 and 209 of one embossing portion 202 to engage with the respective positive or negative embossing features 210 and 211 of the other embossing portion 204. The hinge portion 206 is constructed of a pair of oppositely oriented and spaced-apart living hinges 212 and 214. As shown in FIG. 12, the first living hinge 212 allows engagement of the positive embossing features 210 of the embossing portion 204 to engage with the negative embossing features 209 of the opposite embossing portion 202 when the living hinge 212 is bent and the living hinge 214 is in an unbent state. Similarly, when the living hinge 214 is bent and the living hinge 212 is straight as shown in FIG. 13, the embossing portions 202 and 204 can be pivoted relative to one another in the opposite direction so that the positive embossing features 208 of the embossing portion. 202 can engage with the negative embossing features 211 of the embossing portion 204. When bending about the living hinge 212 to configure the embossing folder 200 as shown in FIG. 12, the upper inner sides 220 and 221 of the living hinge 214 are configured to contact each other to prevent further folding about the living hinge 214. This results in the primary folding to occur about the living hinge 212 so than she positive and negative embossing features 209 and 210 will properly align for embossing. Likewise, when bending about the living hinge 214 to configure the embossing folder 200 as shown in FIG. 13, the upper inner sides 222 and 223 of the living hinge 214 are configured to contact each other to prevent further folding about the living hinge 212. This results in the primary folding to occur about the living hinge 214 so that the positive and negative embossing features 208 and 211 will properly align for embossing.

Figure 14:
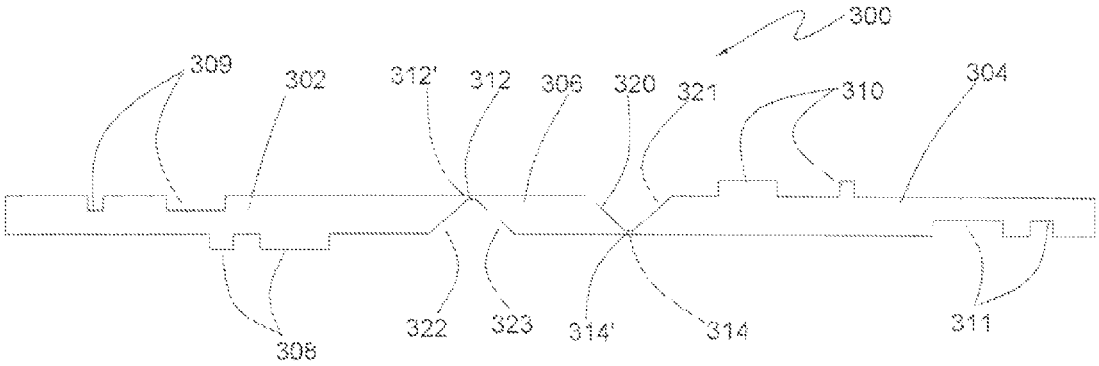
FIG. 14 is a cross-sectional side view of a fourth embodiment of a double-sided embossing folder in accordance with the principles of the present invention.
Figure 15:
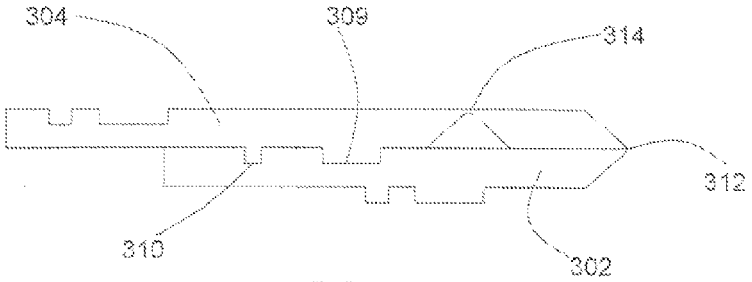
FIG. 15 is a cross-sectional side view of the double-sided embossing folder shown in FIG. 14.

Referring now to FIG. 14, there is illustrated another embodiment of a double-sided embossing folder, generally indicated at 300, in accordance with the principles of the present invention. In this example, the embossing folder 300 is comprised of a first, double-sided embossing portion 302 and a second, double-sided embossing portion 304 separated and adjoined by a hinge portion 306 that is configured to allow the positive and negative embossing features 308 and 309 of one embossing portion 302 to engage with the respective positive or negative embossing features 310 and 311 of the other embossing portion 304. The hinge portion. 306 is constructed of a pair of oppositely oriented and spaced-apart living hinges 312 and 314. As shown in FIG. 15, the first living hinge 312 allows engagement of the positive embossing features 310 of the embossing portion 304 to engage with the negative embossing features 309 of the opposite embossing portion 302 when the living hinge 312 is bent and the living hinge 314 is in an unbent state. Similarly, when the living hinge 314 is bent and the living hinge 312 is straight as shown in FIG. 13, the embossing portions 302 and 304 can be pivoted relative to one another in the opposite direction so that the positive embossing features 308 of the embossing portion 302 can engage with the negative embossing features 311 of the embossing portion 304. The living hinge 312 is formed from inwardly angled surfaces 322 and 323 that form a V-shape channel across the entire width of the embossing folder 300 with a small web 312' of material disposed therein between that forms the living hinge 312. The inwardly angled surfaces 322 and 323 are angled at approximately 60 to 30 degrees relative to the planar outer surfaces of the embossing folder 300. An optimal angle may be between about 45 degrees and about 50 degrees. Similarly, living hinge 314 is formed from inwardly angled surfaces 320 and 321 that form a V-shape channel across the entire width of the embossing folder 300 with a small web 314' of material disposed therein between that forms the living hinge 314. The inwardly angled surfaces 320 and 321 are angled at approximately 60 to 30 degrees relative to the planar outer surfaces of the embossing folder 300. An optimal angle may be between about 45 degrees and about 50 degrees.

Figure 16:
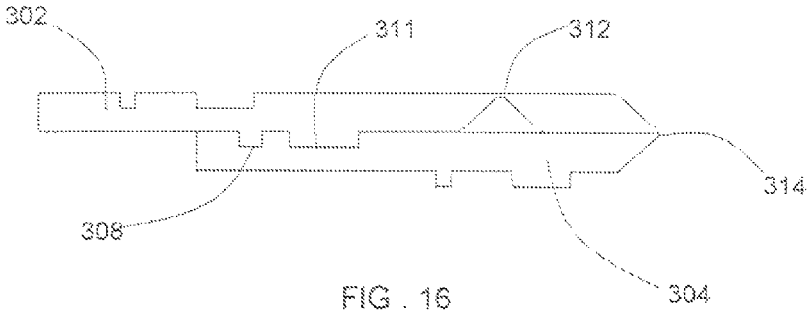
FIG. 16 is a cross-sectional side view of the double-sided embossing folder shown in FIG. 14.
Figure 17:
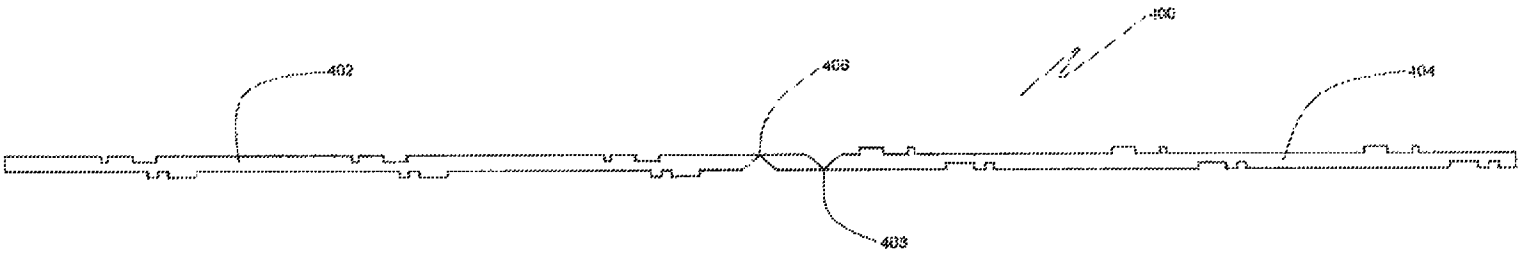
FIG. 17 is a cross-sectional side view of a fifth embodiment of a double-sided embossing folder in accordance with the principles of the present invention.

When bending about the living hinge 312 to configure the embossing folder 300 as shown in FIG. 15, the inner surfaces 320 and 321 of the living hinge 314 are configured to contact each other to prevent further folding about the living hinge 314. This results in the primary folding to occur about the living hinge 312 so that the positive and negative embossing features 309 and 310 will properly align for embossing. Likewise, when bending about the living hinge 314 to configure the embossing folder 300 as shown in FIG. 16, the upper inner sides 322 and 323 of the living hinge 314 are configured to contact each other to prevent further folding about the living hinge 312. This results in the primary folding to occur about the living hinge 314 so that the positive and negative embossing features 308 and 311 will properly align for embossing.

Figure 18:
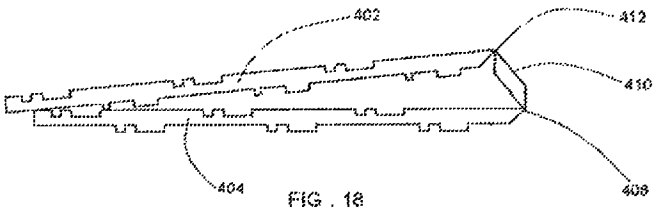
FIG. 18 is a cross-sectional side view of the double-sided embossing folder shown in FIG. 17.
Figure 19:
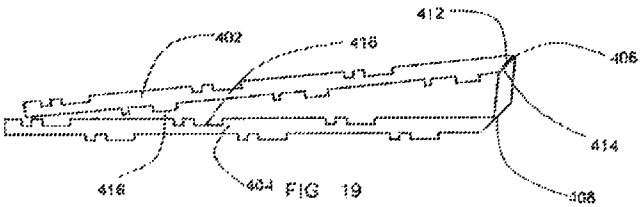
FIG. 19 is a cross-sectional side view of the double-sided embossing folder shown in FIG. 17.
Figure 20:
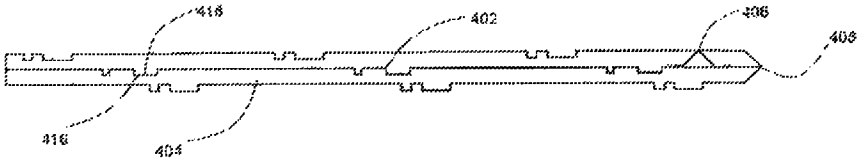
FIG. 20 is a cross-sectional side view of the double-sided embossing folder shown in FIG. 17.

This is further illustrated with reference so the embossing folder, generally indicated at 400 in accordance with the principles of the present invention shown in FIGS. 17, 18, 19 and 20. Again, the embossing folder is comprised of two opposing, double-sided embossing plates 402 and 404 separated by two oppositely oriented living hinges 406 and 408 that are integrally formed with the embossing plates 402 and 404 and each other. As shown in FIG. 18, when bending about the hinge 408, the plate 402 may not lay flat against the plate 404 due to "memory" in the hinge 406 in which the material from which it is composed will cause the plate 402 and bridge portion 410 that is comprised of the material between the hinges 406 and 408 that forms an elongate strip between the plates 404 and 402 across the entire width of the embossing folder 400 in the direction perpendicular to the figures. The width of the elongate strip between the V cuts that form the living hinges, may have a width of approximately about 3 to 12 mm measured from the centers of the V cuts. Optimally, the width may be approximately 6 to 8 mm As shown in FIG. 19, if an attempt is made to unbend the living hinge 408 from the position illustrated in FIG. 18, the inside surfaces 412 and 414 of the hinge 406 will come into contact and prevent further unbending of the hinge 408 when the embossing plate 402 is positioned on top of the plate 404 as shown. This prevents the embossing folder 400 from closing upon itself and thus indicates to a user that the positive features 416 of the plate 402 are not properly aligned with the negative embossing features 418 of the plate 404. When the hinge 108 is bent upon itself 180 degrees as shown in FIG. 20, the back side of the hinge 406 will be substantially planar and the positive features 416 of the plate 402 will properly align with the negative features 418 of plate 404

Figure 21:
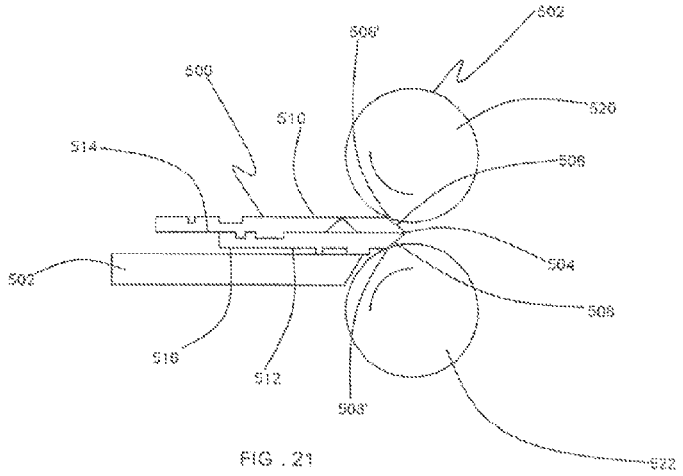
FIG. 21 is a cross-sectional side view of a sixth embodiment of a double-sided embossing folder in accordance with the principles of the present invention being fed through a roller-type machine.

As illustrated in FIG. 21, when an embossing folder 500 in accordance with the principles of the present invention is fed through a roller machine, generally indicated at 502, the embossing folder 500 may be fed on a support platform 503 into the machine 502 with one of the living hinges 504 forming the leading edge. Because, as previously discussed and described herein, the living hinge 504 is formed by a V-shaped recess that when folded about the living hinge 504 forms a dual-tapered leading surface formed by angled surfaces 506 and 508. The transition points 506' and 508' formed between the angled surfaces 506 and 508 and the planar surfaces 510 and 512 of the embossing plates 514 and 516, respectively, of the embossing folder 500, are spaced such that they tangentially contact the rollers 520 and 522 of the roller machine 502. Such contact between the embossing folder 500 and the rollers 520 and 522 of the roller machine 502 cause the embossing plates 514 and 516 to properly align for embossing.

Figure 22:
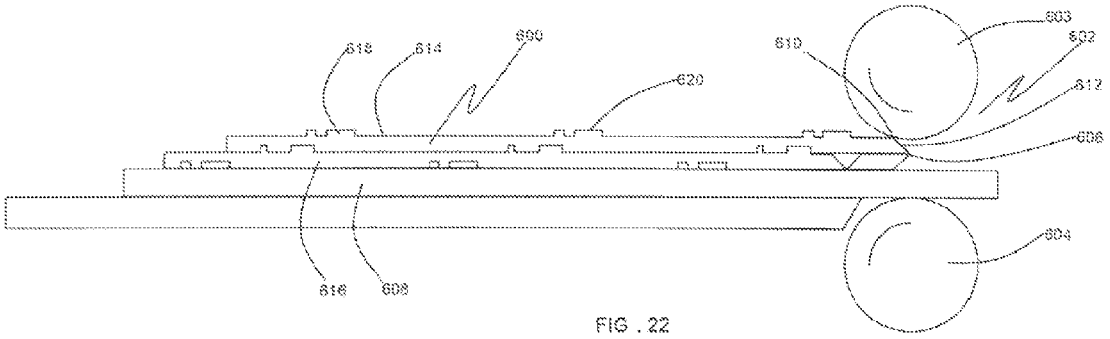
FIG. 22 is a cross-sectional side view of a seventh embodiment of a double-sided embossing folder with a mat in accordance with the principles of the present invention being fed through a roller-type machine.

Depending on the spacing between the rollers 603 and 604 of a roller machine 602 as shown in FIG. 22 and the overall thickness of an embossing folder 600 when folded in two about a living hinge 606 as shown in FIG. 22, it may be necessary to provide a mat or pad 608 upon which the embossing folder 600 lies that, together with the embossing folder 600, is fed through the roller machine. The combined thickness of the mat 608 and embossing folder 600 is such that the transition 610 between the angled leading edge 612 formed as a result of the bending of the living hinge 606 contacts the roller 603 to align the embossing folder 600 as it is fed through the roller machine. This leading edge 612 not only causes proper alignment of the two embossing plates 614 an 616 for proper embossing, but also aligns the leading edge 612 to be substantially parallel to the roller 602, which has a width at least as wide as the embossing folder 600, so that the embossing folder 600 is fed in a direction that the side 618 of the embossing folder 600 stays substantially parallel to a longitudinal axis of the roller as the embossing folder 600 is fed through the rollers 602 and 604. This prevents the embossing folder 600 from becoming bound in the machine 602 or, more importantly, from twisting about the roller 602 as it is fed through the machine. Because the positive embossing features 620 of the embossing folder 600 will come into direct contact with the roller 602, such twisting may cause damage to the positive embossing features 602 as the roller 602 slips over such positive embossing features 620. Proper alignment of the embossing folder 600 with the roller 602 at the point of engagement of the embossing folder 600 with the roller according to the present invention prevents such twisting from occurring.

For a double sided embossing folder according to the present invention in which the thickness of one side is approximately 2.0 mm, including raised positive embossing features having a height of approximately 0.5 mm above the base surface of the embossing folder and corresponding negative embossing features having a depth of 0.5 mm to receive the positive embossing features therein, the overall thickness of such an embossing folder will be approximately 3.5 mm when folded. An embossing folder having these dimensions can be used in various roller-type and pressing-type machines used in the art for die cutters of various configurations and thicknesses. As such, the various roller machines on the market today are provided with roller spacing to accommodate the particular die cutter for which the machine was designed. To use the embossing folders of the present invention with such preexisting machines, the pad or mat used with the embossing folder provides additional thickness when fed through such a machine with the embossing folder as shown in FIG. 22. Thus, various pads or mats may be provided so that the embossing folder can be used with any number of machines having different roller spacing. In addition, multiple pads or mats may be combined to accommodate roller machines in which a single pad or mat does not provide the correct overall height. For example, for a roller machine having a roller spacing of approximately 21.1 mm, it may be necessary to provide a plurality of pads and mats. Thus, a first pad may have a thickness of 13.1 mm, a first mat may have a thickness of 3.0 mm and a second mat may have a thickness of 2 mm. In addition, the pads and mats may be comprised of different materials. For example the pads may be formed from polypropylene and the mats from polycarbonate. Of course, other materials known in the art may also be employed.

Figure 23:
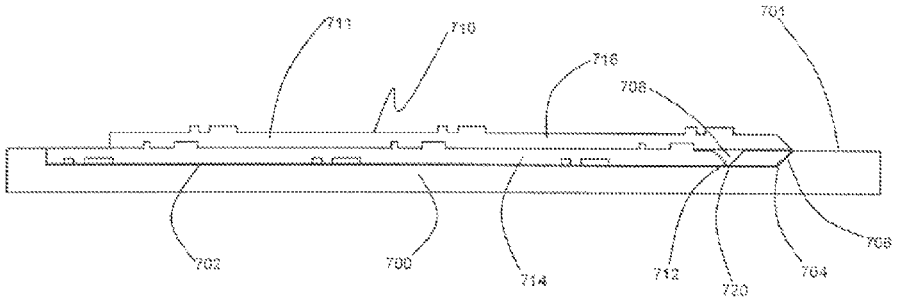
FIG. 23 is a cross-sectional side view of an eighth embodiment of a double-sided embossing folder with a support tray in accordance with the principles of the present invention.

As further shown in FIG. 23, rather than using a rectangular mat or pad to support the undersurface of the embossing folder as previously described herein, a support tray 700 may be provided that is provided with a recess 702 formed in a top surface thereof for receiving and support an embossing folder 710 according to the present invention. The recess 702 is generally rectangular in shape to substantially match the generally rectangular outer perimeter of the embossing folder 710 when folded as illustrated. In addition, the recess 702 is configured with a front angled surface 704 to substantially match the front leading edge surface 706 of the embossing folder 710. In addition, a triangularly shaped protrusion 708 is formed on the inside side wall surface of the recess 702 to engage with the triangularly shaped gap 712 formed between the lower and upper halves 714 and 716 of the embossing folder 710 that is formed by the V notch forming the second living hinge 720. By forcing the embossing folder 710 into the recess 702 and causing the protrusion. 708 to engage the gap 712, the folder 710 is temporarily retained within the tray 700. The top surface 701 of the tray 700 is substantially planar with the base surface 711 of the lower half 714 of the embossing folder 710. Thus, since the tray 700 is wider in all directions than the embossing folder 710, the top surface 701 of the tray can support a sheet of paper that extends beyond the perimeter of the embossing folder 710 so that the paper is not caused to crease along the edge of the embossing folder during an embossing process. This is particularly useful when embossing occurs through use of a hand held roller that is roiled over the top surface of the embossing folder 710 to emboss a sheet of paper. Normally, the user will cause the roller to roll over the perimeter sides of the embossing folder 710 thus causing slight creases in the paper at the edges of the embossing folder. Such unwanted creases can be eliminated by providing the tray 700 so that the user can still roll over the perimeter side edges of the embossing folder without having to roll over the outer perimeter sides of the tray 700 so that the entire surface of the embossing folder 710 can be properly pressed and the user does not have to take special care along the edges of the embossing folder 710.

While there have been described what are believed to be the best embodiments of the present invention, those skilled in the art will recognize that other and further changes and modifications may be made thereto without department from the spirit of the invention, and it is intended to claim all such changes and modifications that fall within the true scope of the invention. In addition, while the devices set forth herein have been described with specific reference to a particular structure and shape, the device of the present invention could be modified to any desired shape or size. Thus, while various embodiments of the present invention are described herein, any methods or devices similar or equivalent, to those described herein may be used in the practice or testing of the present invention. All references cited herein are incorporated by reference in their entirety and for all purposes.

While the foregoing advantages of the present invention are manifested in the illustrated embodiments of the invention, a variety of changes can be made to the configuration, design and construction of the invention to achieve those advantages. Hence, reference herein to specific details of the method and function of the present invention is by way of example only and not by way of limitation. Unless defined otherwise, all technical and scientific terms used herein have the same meanings as commonly understood by one of ordinary skill in the art to which this invention belongs. It is also to be understood that, as used herein and in the appended claims, the singular forms "a," "an," and "the" include plural reference, unless the context clearly dictates otherwise.

What is claimed is:

1. An embossing folder, comprising;

a first embossing plate having a first planar surface including a first plurality of positive embossing features disposed thereon in the shape of a first image and a second planar surface opposite the first planar surface including a first plurality of negative embossing features formed therein defining a second image, the first and second images being different from one another;

a second embossing plate having a third planar surface including a second plurality of positive embossing features disposed thereon in the shape of the second image and configured to mate with the first plurality of negative embossing features and a fourth planar surface opposite the third planar surface including a second plurality of negative embossing features formed therein in the shape of the first image and configured to mate with the first plurality of positive embossing features;

at least one hinge interposed between and integrally formed with the first and second embossing plates, the at least one hinge formed from at least one V-cut formed between the first and second embossing plates to form inwardly tapered sides.

2. The folder of claim 1, wherein said at least one hinge is comprised of a single hinge defined by a first pair of inwardly tapered portions extending from the second and third planar surfaces to a web portion and a second pair of inwardly tapered portions extending from the first and fourth planar surface to the web.

3. The folder of claim 2, wherein the first and second pair of inwardly tapered portions have a slenderness ratio sufficient to allow the single hinge to allow pivoting of the first embossing plate nearly 360 degrees relative to the second embossing plate and to allow engagement of corresponding positive and negative embossing features on both sides of the embossing folder to properly engage during embossing.

4. The folder of claim 3, wherein the ratio of the length to thickness of the inwardly tapered portions is approximately between about 5:1 and 7.5:1.

5. The folder of claim 1, wherein when the at least one hinge is bent until the first planar surface contacts and lies substantially planar to the fourth planar surface of the second planar surface contacts and lies substantially planar to the third planar surface, the inwardly tapered sides form a tapered leading edge.

6. An embossing folder, comprising;

a substantially planar sheet of plastic having a first and second side, the sheet defining a first embossing half and a second embossing half;

at least one transversely extending hinge interposed between the first and second embossing halves configured to allow bending along the at least one hinge so that the first side of the first embossing half contacts and lies in a planar relationship with the first side of the second embossing half when engaged therewith and the second side of the first embossing half contacts and lies in a planar relationship with the second side of the second embossing half when engaged therewith;

a first plurality of positive embossing features disposed on a first side of the first embossing half in the shape of a first image and a first plurality of negative embossing features formed in the first side of the second embossing half, the first plurality of positive and negative embossing features configured to mate with one another;

a second plurality of positive embossing features disposed on a second side of the second embossing half in the shape of a second image and a second plurality of negative embossing features formed in the second side of the first embossing half, the second plurality of positive and negative embossing features configured to mate with one another therein defining a second image, the first and second images being different from one another;

at least one hinge formed in the sheet and defining the first and second embossing halves, the at least one hinge formed from at least one channel extending laterally across the sheet forming inwardly tapered sides.

7. The folder of claim 6, wherein said at least one hinge is comprised of a single hinge defined by first and second inwardly tapered portions extending from the first and second embossing halves, respectively, to a web interposed between the first and second inwardly tapered portions.

8. The folder of claim 7, wherein the first and second inwardly tapered portions have a slenderness ratio sufficient to allow the single hinge to allow pivoting of the first embossing plate nearly 360 degrees relative to the second embossing plate and to allow engagement of corresponding positive and negative embossing features on both sides of the embossing folder to properly engage during embossing.

9. The folder of claim 8, wherein the ratio of the length to thickness of the inwardly tapered portions is approximately between about 5:1 and 7.5:1.

10. The folder of claim 6, wherein when the at least one hinge is bent until the first side of the first embossing half contacts and lies substantially planar to the first side of the second embossing half or the second side of the first embossing half contacts and lies substantially planar to the second side of the second embossing half, the inwardly tapered sides form a tapered leading edge.

* * * * *